US009999559B2

(12) United States Patent
Sabota et al.

(10) Patent No.: US 9,999,559 B2
(45) Date of Patent: Jun. 19, 2018

(54) INFANT WARMING DEVICE WITH INTEGRATED TOUCH SCREEN AND DISPLAY ISOLATION MOUNTING

(71) Applicant: Segars California Partners, LP, Austin, TX (US)

(72) Inventors: Peter D. Sabota, Austin, TX (US); Michael J. Hankins, Jonestown, TX (US)

(73) Assignee: Segars California Partners, LP, Austin, TX (US)

( * ) Notice: Subject to any disclaimer, the term of this patent is extended or adjusted under 35 U.S.C. 154(b) by 217 days.

(21) Appl. No.: 14/900,150

(22) PCT Filed: Jun. 14, 2014

(86) PCT No.: PCT/US2014/042436

§ 371 (c)(1),
(2) Date: Dec. 19, 2015

(87) PCT Pub. No.: WO2014/201443

PCT Pub. Date: Dec. 18, 2014

(65) Prior Publication Data

US 2016/0136025 A1 May 19, 2016

Related U.S. Application Data

(60) Provisional application No. 61/835,514, filed on Jun. 14, 2013.

(51) Int. Cl.
*A61G 11/00* (2006.01)

(52) U.S. Cl.
CPC ..... *A61G 11/00* (2013.01); *A61G 2203/16* (2013.01)

(58) Field of Classification Search
CPC ..... A61G 11/00–11/009; A61G 2203/16
See application file for complete search history.

(56) References Cited

U.S. PATENT DOCUMENTS

| | | | | |
|---|---|---|---|---|
| 2004/0163574 | A1 | 8/2004 | Schoenbach et al. | |
| 2005/0085687 | A1 | 4/2005 | MacKin et al. | |
| 2006/0117482 | A1 | 6/2006 | Branson | |
| 2010/0271324 | A1* | 10/2010 | Hayes | G06F 3/03547 345/173 |
| 2011/0227849 | A1 | 9/2011 | Olien et al. | |
| 2012/0092812 | A1* | 4/2012 | Lewis | A61B 5/14532 361/679.01 |
| 2012/0116150 | A1 | 5/2012 | Falk et al. | |
| 2013/0150655 | A1* | 6/2013 | Ten Eyck | A61G 11/003 600/22 |

* cited by examiner

*Primary Examiner* — Thaddeus Cox
(74) *Attorney, Agent, or Firm* — Barnes & Thornburg LLP

(57) ABSTRACT

In an infant warming device, an isolation mounting system supports the weight of an integrated touch screen assembly during transport and during transport, but does not apply any forces normal to the plane of the display that would weaken the adhesive bonds between the touch screen cover glass and the touch screen, and the touch screen and the display, which could cause separation of the integrated touch screen.

3 Claims, 10 Drawing Sheets

INFANT WARMING DEVICE WITH INTEGRATED TOUCH SCREEN AND DISPLAY ISOLATION MOUNTING

CROSS-REFERENCE TO RELATED APPLICATIONS

This application claims the benefit of U.S. Provisional application 61/835,514 filed Jun. 14, 2013.

BACKGROUND

This disclosure relates to the field of various infant warming devices that are used to provide heat support to premature infants who cannot sustain their own body temperature. In the treatment of infants, and particularly those born prematurely, it is necessary to provide heat to the infant during the care and treatment of the infant and to minimize heat loss from the infant's body. An apparatus for providing such heat will be referred to in this disclosure as an infant warming device. In general such an apparatus comprises a flat planar surface on which the infant rests while various procedures are carried out. There are normally protective guards that surround the infant and some type of overhead heater directing radiant energy toward the infant. It should be understood that these infant warming devices might have other descriptive names, such as, for example, an infant care device, or an infant care center, patient care center, an infant incubator, or a combination device, and this disclosure anticipates any of those other names. This disclosure will use the term infant warming device.

Many infant warming devices feature a touch screen and display that is used for displaying both patient and equipment information. In addition caregivers use the touchscreen to enter patient or equipment information and to change equipment settings.

In mounting a touch screen and display into Infant warming devices the standard methods of mounting will cause stresses on the bonds between the high strength cover glass and the touch screen, and the bonds between the touch screen and the display.

There is a need then to have a new approach to mounting the touch screen and display that would remove the stress in the axis normal to the touch screen and reduce the stresses in the other two directions induced by the alignment of the mounting hardware. This new approach should fully support the weight of the screen in these other two directions in order to hold the display in place and handle the shocks and vibrations on the device as it is moved or transported

BRIEF SUMMARY

This need can be met by incorporating an isolation mounting system for eliminating any stresses to the bonds that adhere the cover glass to the touch screen and the touch screen to the display. The design supports the weight of the display required to mount it to the device and during transport, but does not apply any forces normal to the plane of the display that would weaken the bonds, which could cause separation of the display. The design uses isolation mounts to accomplish the zero loading of that axis, as well as reducing the stresses in the other axes.

This need can be met by an infant warming device including a patient bed, supporting sidewalls, associated warming mechanisms, and a vertical column structure mounted on the infant warming center including at least: an integrated touch screen assembly; a touch screen mounting plate for the integrated touch screen assembly; a recessed pocket in the vertical column structure for accepting the integrated touch screen assembly; wherein the integrated touch screen assembly and the touch screen mounting plate for the integrated touch screen assembly is mounted from the rear of the vertical column structure with shoulder screws using isolation grommets which allow the touch screen assembly to float.

DESCRIPTION OF DRAWINGS

There are disclosed in the drawings and detailed description to follow various embodiments of the solution proposed herein. It should be understood, however, that the specific embodiments given in the drawings and entailed description do not limit the disclosure. On the contrary, they provide the foundation for discerning the alternative forms, equivalents, and modifications that will be encompassed in the scope of the eventual claims.

DETAILED DESCRIPTION

Figure 1:
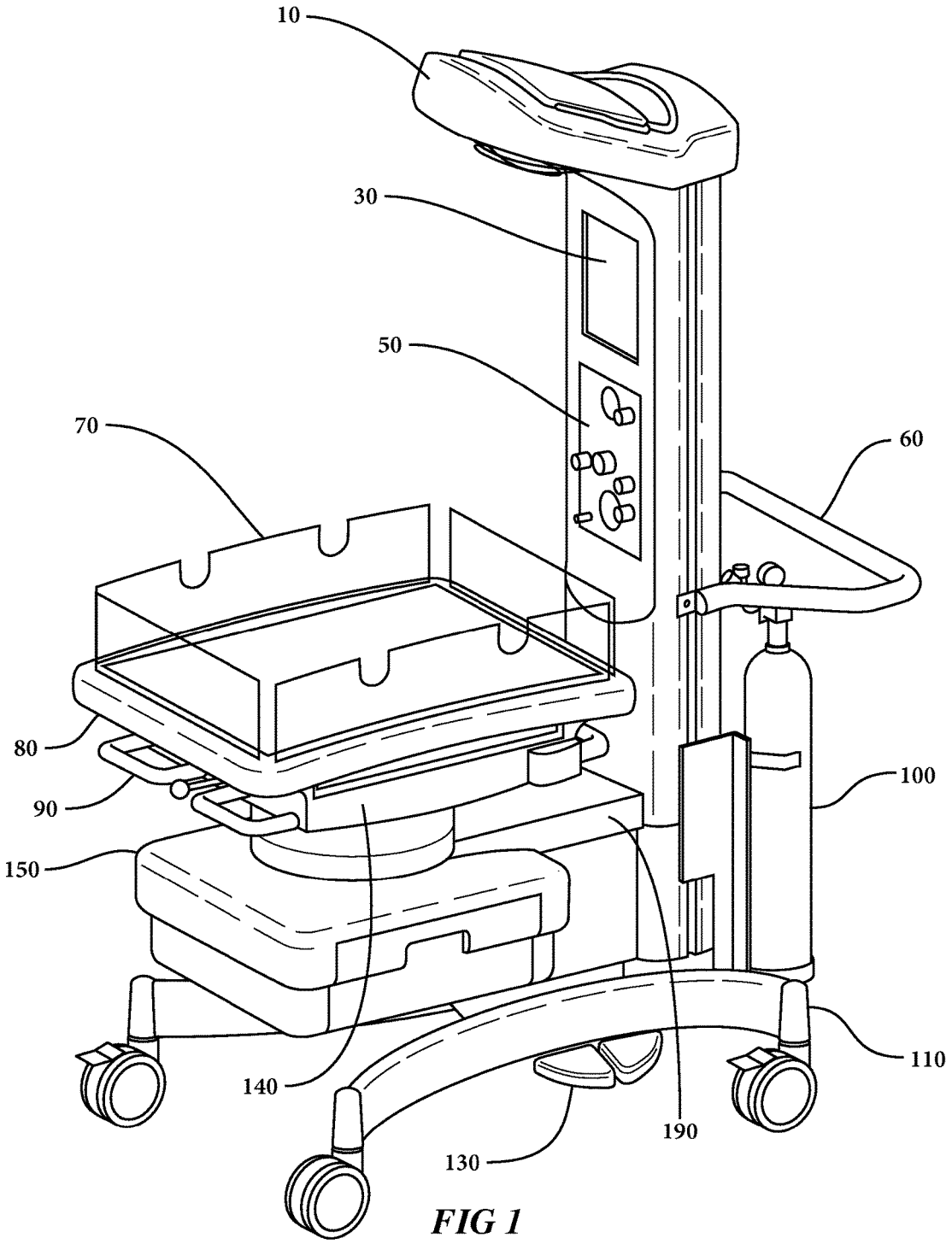
FIG. 1 is a view of an infant care center that can include the inventive concept to be described in this disclosure.
Figure 2:
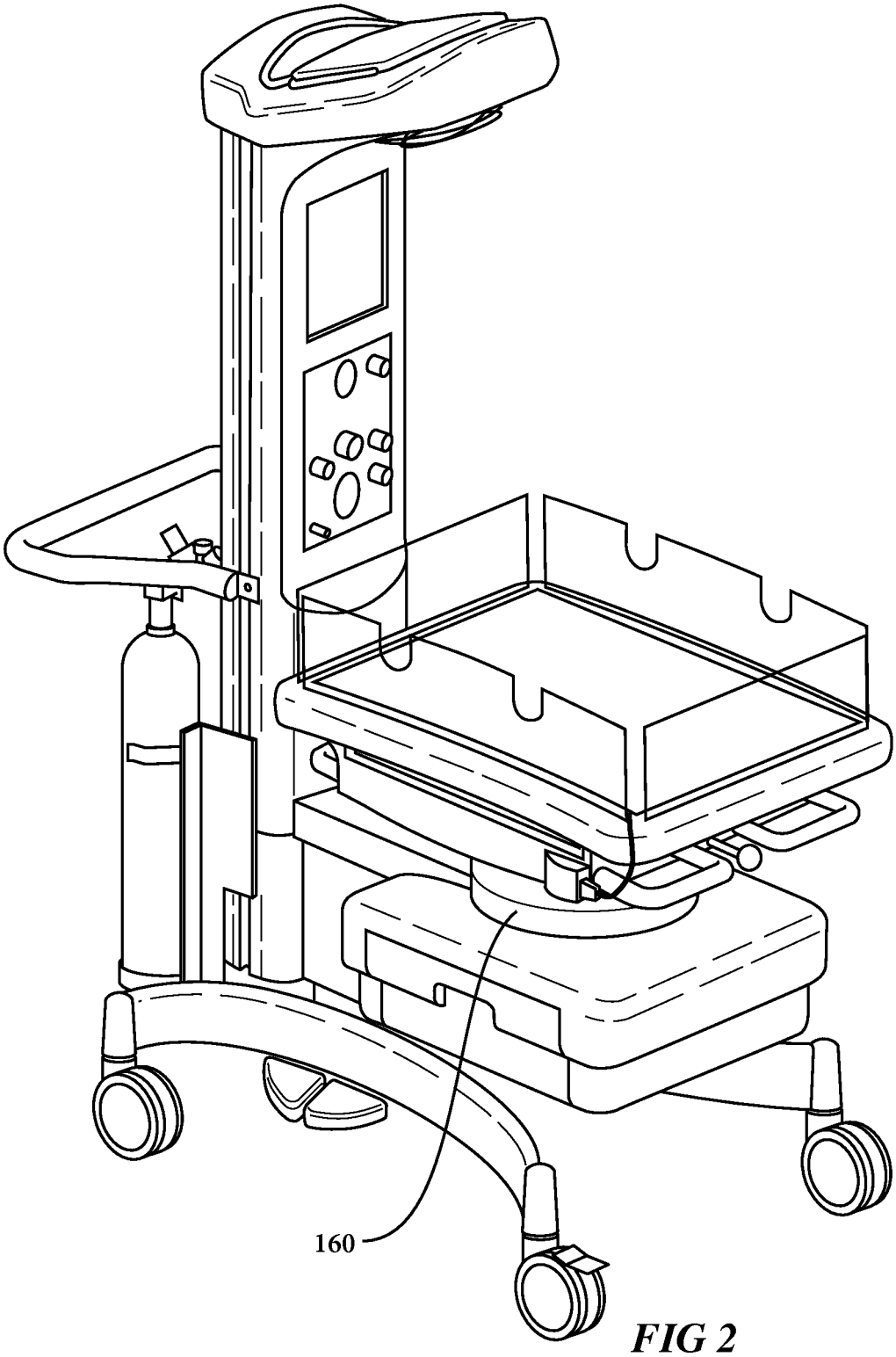
FIG. 2 is an alternate view of an infant care center that can include the inventive concept to be described in this disclosure.
Figure 3:
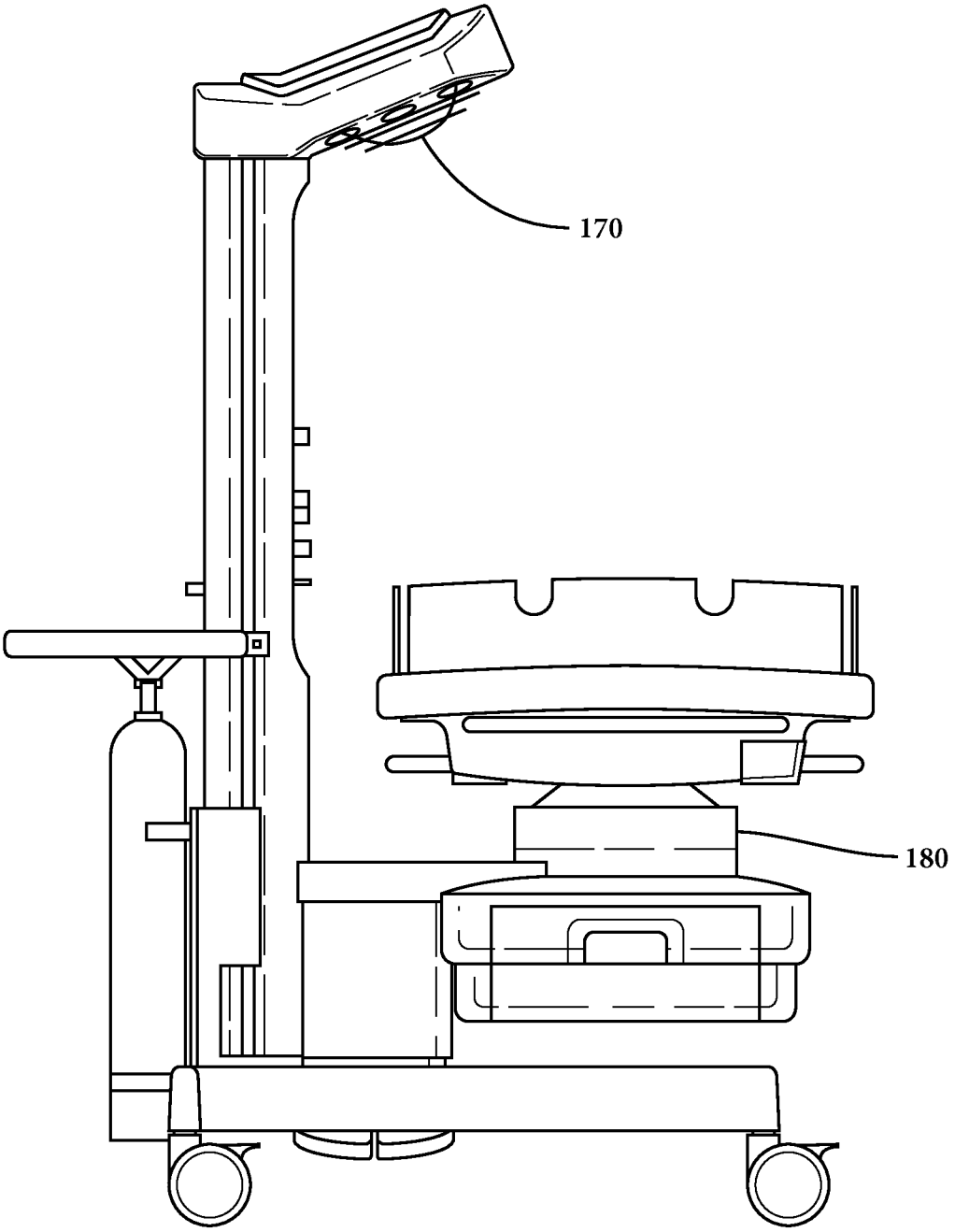
FIG. 3 is an alternate view of an infant care center that can include the inventive concept to be described in this disclosure.

Referring now to FIGS. 1, 2, and 3, several views of an infant warming center that can include the inventive concept to be described in this disclosure. The center includes an infant bed 80 that underlies an infant positioned thereon. The infant bed has a surrounding sidewall 70 and rides upon a patient support mechanism 140. The patient bed and surrounding sidewalls may enclose a heated mattress. A vertical column structure mounted on the infant warming center supports a radiant heater head 10, containing a radiant heater 170 (FIG. 3), with that radiant heater. The radiant heater assembly is designed to optimize the heat focused on the infant. The vertical column structure may have a user interface/display or touchscreen 30 which can be used for both input and output of information. The column may include a resuscitation module 50. The infant warming device's main computer controller may reside in the vertical column structure or may reside in the patient support mechanism. Handles 60, 90, are used to move the infant warming device around as it can be moved on flat surfaces via legs 110 with attached wheels and controlled with footswitches 130. On the rear side of the column is a location for carrying a remote gas supply tank 100. Under the patient support mechanism 140 is a cantilever cover 160 and turret cover 180 for shrouding the rotation mechanisms, with a cantilever arm 190 that supports the patient support, vertical column, and supports a storage enclosure 150.

Figure 4:
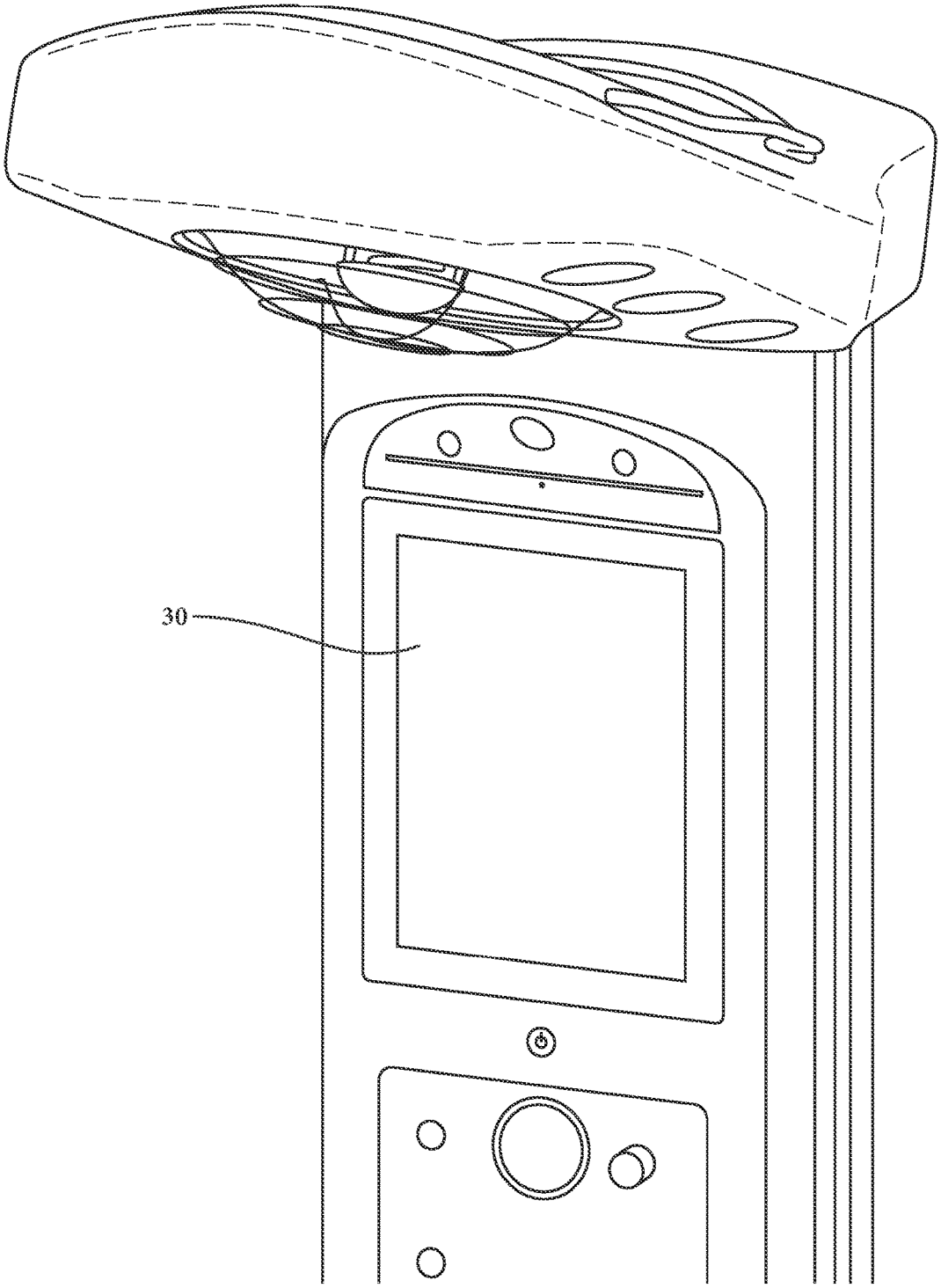
FIG. 4 is an illustrated view of the warming device illustrating the location of the integrated touch screen.

FIG. 4 illustrates the location of the completed configuration of the integrated touch screen 30 in the vertical column structure of the infant warming device.

Figure 5:
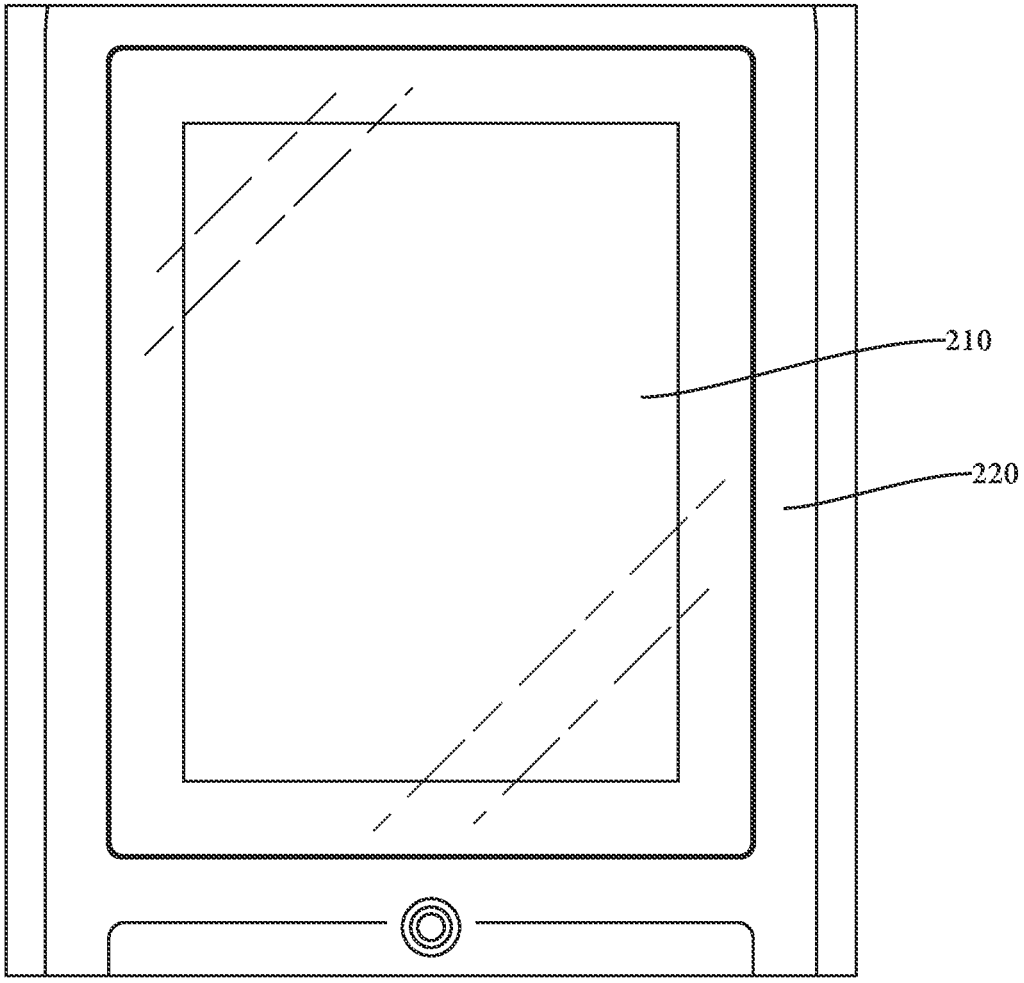
FIG. 5 is a front view of the of the touch screen cover glass over the integrated touch screen assembly.

FIG. 5 a front view of an integrated touch screen assembly. In this front view what can be seen is the touch screen cover glass 210 that covers the touch screen (not visible in this view). The integrated touch screen assembly (245 in FIG. 6) is positioned within the vertical column housing 220 of the vertical column structure of the infant warming device.

Figure 6:
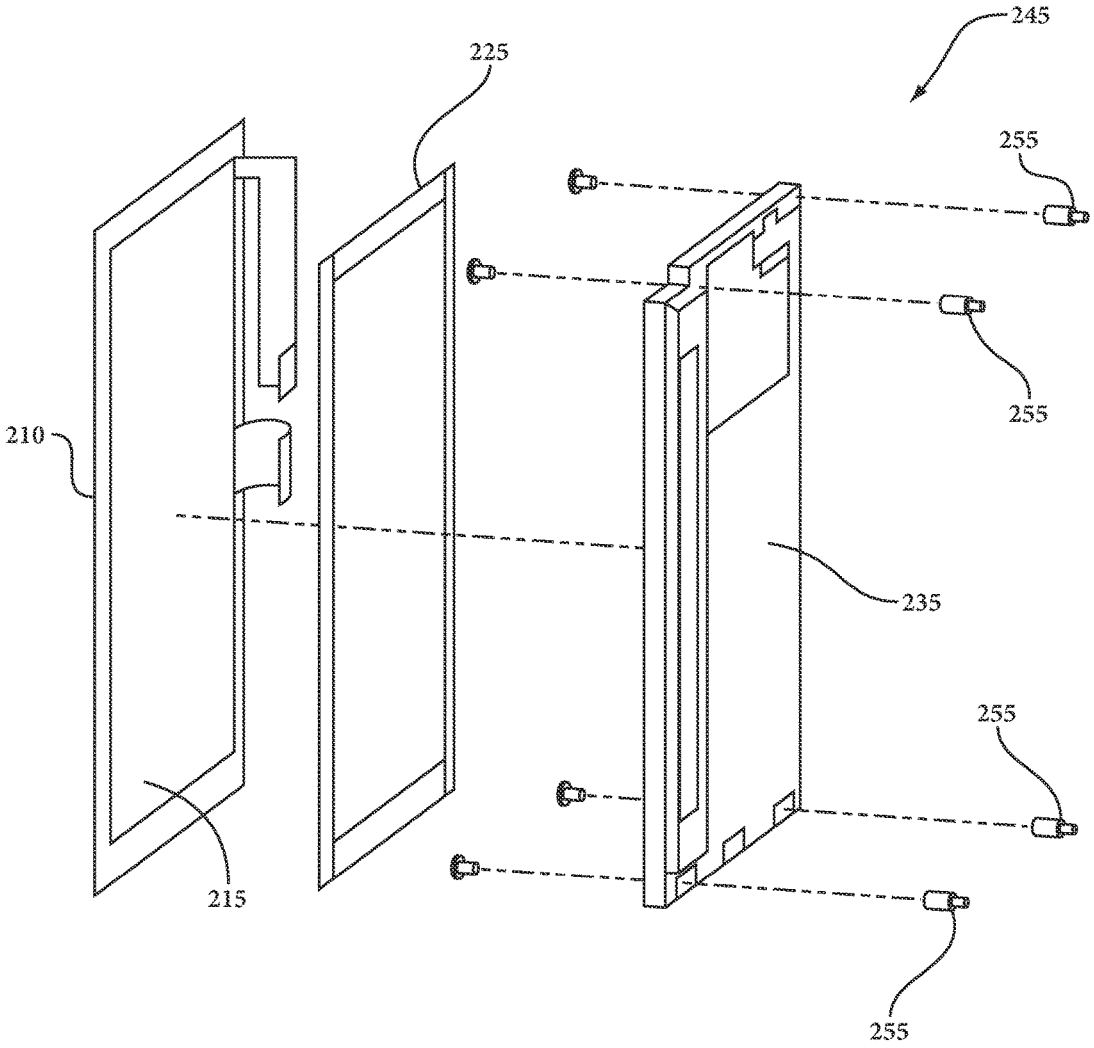
FIG. 6 is an exploded view of the makeup of the integrated touch screen assembly.

FIG. 6 is an exploded view of the complete integrated touch screen assembly 245 comprising the front touch screen cover glass 210, bonded to a touchscreen 215. A display 235 is then attached to the complete assembly through the use of double sided adhesive tape 225. This display may be an SVGA display. Mounting studs 255 extend from the back of display 235 to be used in attaching a touch screen mounting plate (300 in FIG. 9).

Figure 7:
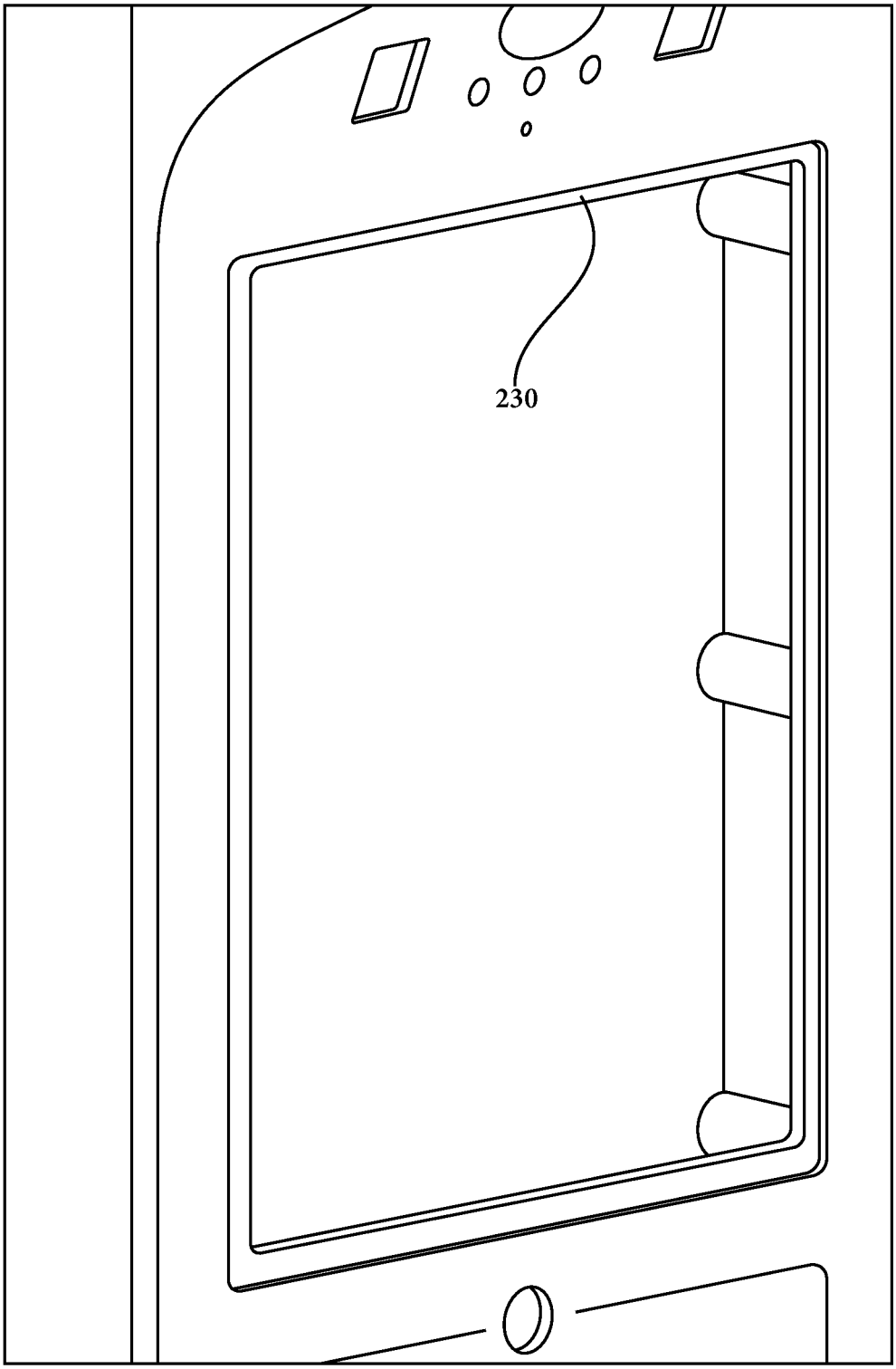
FIG. 7 is a perspective view of the touch screen mounting area.

FIG. 7 is a perspective view of the touch screen mounting area and illustrates a recessed pocket 230 in which the integrated touch screen assembly is positioned.

Figure 8:
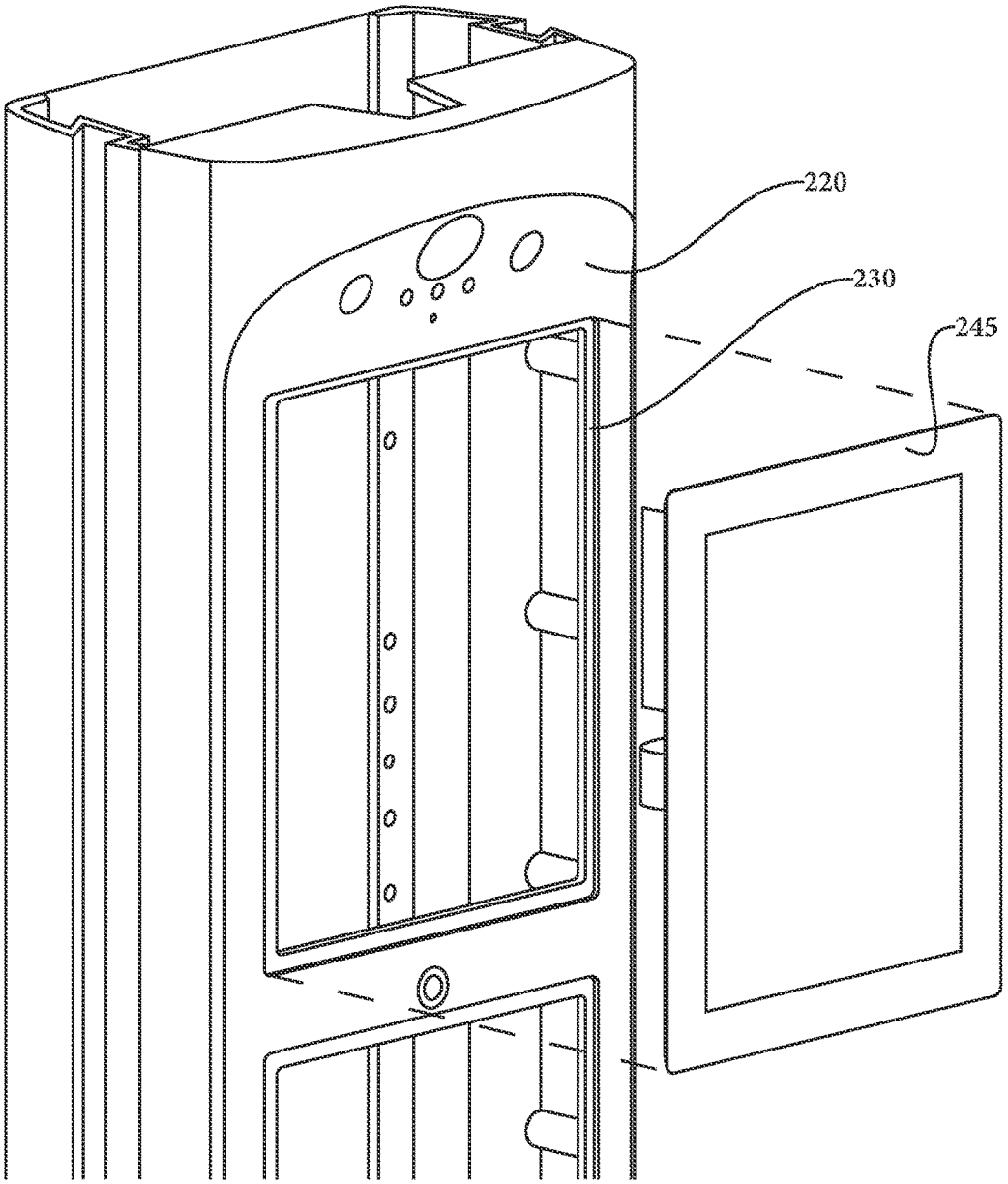
FIG. 8 illustrates the mounting of the touch screen assembly into the housing.

FIG. 8 illustrates the mounting of the integrated touch screen assembly 245 into the vertical column housing 220 and its placement into the recessed pocket 230. The integrated touch screen assembly 245 can be mounted into the recessed pocket 230 and be secured by an adhesive. The adhesive sets the position of the screen and all associated mounting hardware floats to accommodate this set position.

Figure 9:
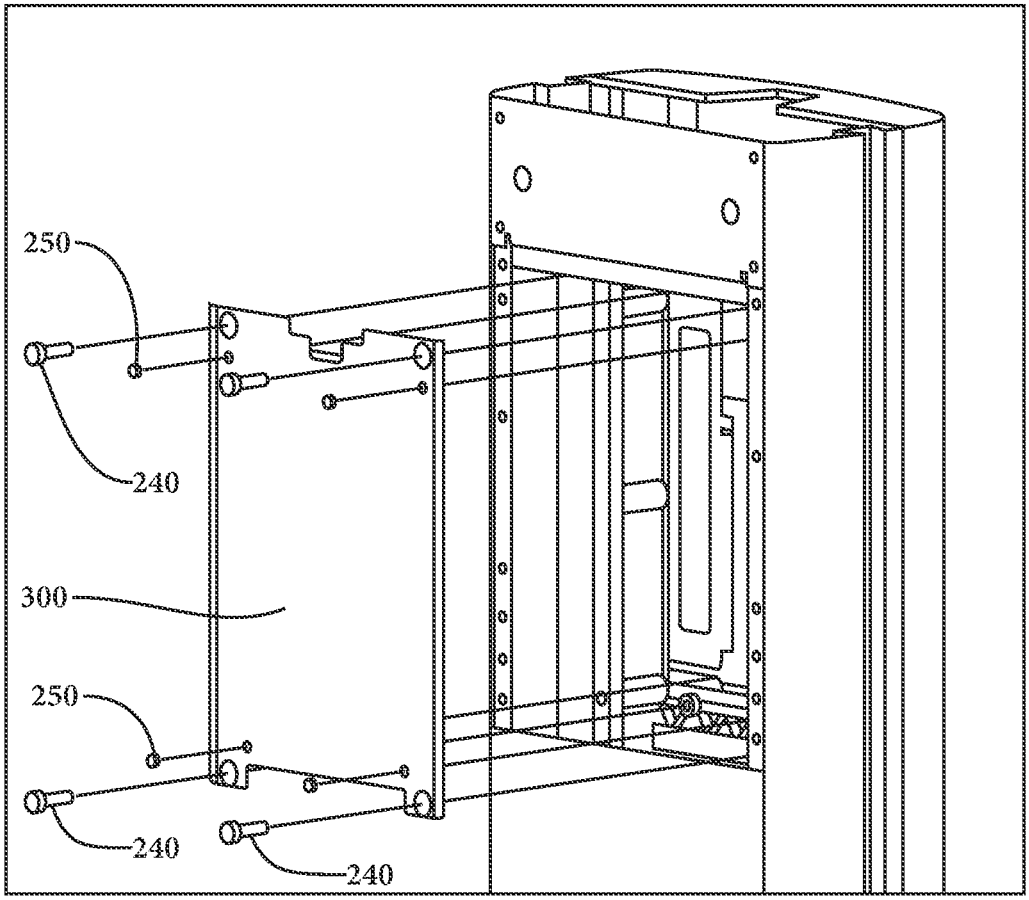
FIG. 9 is a rear view of the touch screen assembly mounting.
Figure 9:
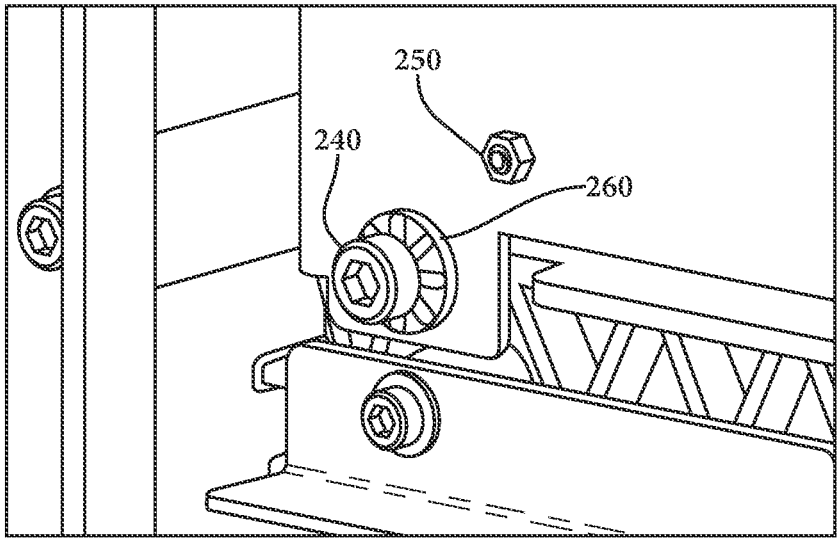

FIG. 9 is a rear view of the touch screen and display mounting, illustrating a number of elements that provides stress and isolation mounting system for eliminating any stresses to the bonds that adhere the cover glass to the touch screen and the touch screen to the display, due to the front and rear gaps of the shoulder screw 240 (to be described). The design supports the weight of the display required to mount it to the device and during transport, but does not apply any forces normal to the plane of the display that would weaken the bonds, which could cause separation of the display. The touch screen assembly mounts to the mounting plate by use of studs 255 on the back of the display 235 (see FIG. 6). These studs go through the mounting plate and rigidly mount using nuts 250. The design then uses isolation mounts to accomplish the zero loading of that axis. This is done by the use of Isolation grommets 260 in conjunction with the shoulder screws 240 that act to remove stresses normal to the plane of the touch screen. Shown in this figure is the use of the four shoulder screws 240 and nuts 250 used to affix the integrated touch screen assembly and the touch screen mounting plate 300 to the inside of the vertical column structure. Therefore the touch screen mounting plate 300 rides on the shoulder screws 240 and the integrated touch screen assembly floats freely.

Figure 10:
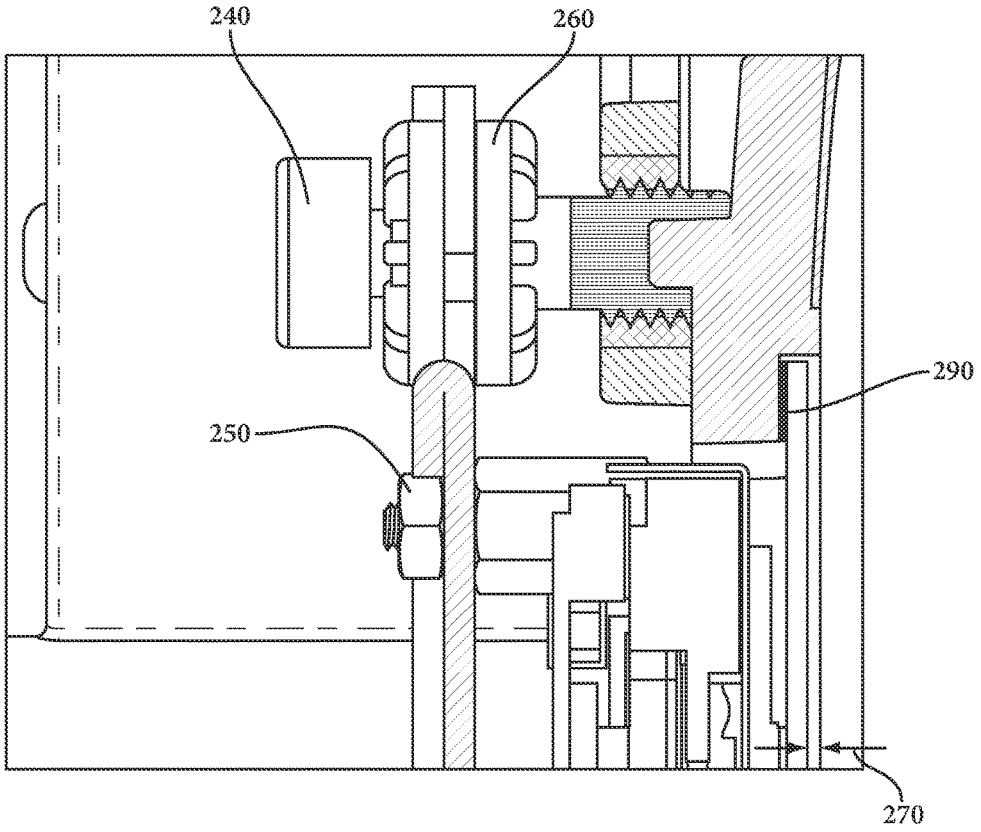
FIG. 10 illustrates the zero stress mounting of the touch screen assembly.

FIG. 10 illustrates the zero stress mounting of the display and touch screen, including the shoulder screws 240 passing through isolation grommets 260 and large mounting holes of the touch screen mounting plate 300 to reduce the force exerted by the rigidly mounted nuts 250. The adhesive mentioned in FIG. 7 is shown as 290. Finally a provided gap 270 provides further isolation by preventing the display pushing against another surface. These design elements eliminate forces to the bonding that adheres the cover glass to the touch screen and the touch screen to the display and the display to the vertical column housing. This combination of elements eliminates forces on the bonding between the cover glass 210; touch screen 215, and display 235, thus reducing any chance of delaminating of the critical adhesive bonds and thus failure.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

Advantage Over the Prior Art

The isolation mounting system eliminates forces on the bonding between the cover glass 210; touch screen 215, and display 235, thus reducing any chance of delaminating of the critical adhesive bonds and thus failure.

What is claimed is:

1. An infant warming device comprising:

a cantilevered arm, a patient bed positioned above the cantilevered arm, a number of supporting sidewalls, a warming mechanism for heating the patient bed, a vertical column structure supported on the cantilevered arm, the vertical column structure having a front side that faces the patient bed and a rear side positioned opposite the front side, an integrated touch screen assembly including a display and a number of threaded mounting studs that extend rearward from the display, a touch screen mounting plate positioned behind the integrated touch screen assembly, the touch screen mounting plate including a first number of openings, each opening having a threaded mounting stud of the integrated touch screen assembly extending therethrough, and a recessed pocket in the vertical column structure in which the integrated touch screen assembly is positioned, wherein the touch screen mounting plate includes a second number of openings spaced apart from the first number of openings, wherein an isolation grommet is positioned in each opening of the second number of openings, and a shoulder screw passes through each isolation grommet to extend toward the front side of the vertical column structure, and wherein each shoulder screw is secured in a rear-facing threaded hole in the vertical column structure and a nut is secured to each threaded mounting stud of the integrated touch screen assembly on a back surface of the touch screen mounting plate such that the integrated touch screen assembly and the touch screen mounting plate for the integrated touch screen assembly are mounted from the rear side of the vertical column structure with the shoulder screws using the isolation grommets to permit the touch screen assembly to float.

2. The infant warming device of claim 1 wherein the integrated touch screen assembly comprises:

a touch screen cover glass; a touch screen bonded to the touch screen cover glass; and the display is bonded to the touch screen cover glass and touch screen.

3. The infant warming device of claim 1 wherein the integrated touch screen assembly is bonded within the recessed pocket by use of an adhesive.

* * * * *